US005697457A

United States Patent [19]

Back

[11] Patent Number: 5,697,457

[45] Date of Patent: Dec. 16, 1997

[54] NO LOAD DERRICK FOR DRILLING RIG

[75] Inventor: Carl F. Back, Winter Haven, Fla.

[73] Assignee: Laibe Supply Corporation, Indianapolis, Ind.

[21] Appl. No.: 759,321

[22] Filed: Dec. 2, 1996

Related U.S. Application Data

[63] Continuation of Ser. No. 318,985, Oct. 6, 1994, abandoned.

[51] Int. Cl.[6] ..... F21B 7/02

[52] U.S. Cl. ..... 173/185; 173/186; 173/28; 173/148; 173/152

[58] Field of Search ..... 173/28, 141, 148, 173/149, 184, 185, 186, 147, 152

[56] References Cited

U.S. PATENT DOCUMENTS

| | | | |
|---|---|---|---|
| 2,410,959 | 11/1946 | Brown | 173/147 |
| 2,869,826 | 1/1959 | Thornburg | 173/147 |
| 3,131,776 | 5/1964 | Kvello-Aune et al. | 173/149 |
| 3,768,578 | 10/1973 | Russell, Jr. | 173/150 |
| 3,814,194 | 6/1974 | Reich et al. | 173/28 X |
| 3,867,989 | 2/1975 | Hisey et al. | 173/147 |
| 3,920,084 | 11/1975 | Russell, Jr. | 173/79 |
| 3,957,125 | 5/1976 | Russell, Jr. | 173/150 |
| 3,958,376 | 5/1976 | Campbell | 52/116 |
| 4,088,289 | 5/1978 | Wood et al. | 173/28 X |
| 4,703,812 | 11/1987 | Johnson | 173/28 X |
| 4,877,091 | 10/1989 | Howell, Jr. | 173/89 |
| 5,094,302 | 3/1992 | Back | 173/28 |

*Primary Examiner*—Joseph J. Hail, III
*Assistant Examiner*—Jay A. Stelacone
*Attorney, Agent, or Firm*—Woodard, Emhardt, Naughton Moriarty & McNett

[57] ABSTRACT

A mobile drilling rig has a rectangular tubular derrick or mast normally transported on the truck in a generally horizontal attitude. The mast is pivoted to vertical at the drilling site. A drill rotating power head is connected to a pull-down system located inside the mast tube and which includes a rectangular guide tube slidably mounted inside the mast tube, and two double-acting hydraulic cylinder assemblies situated in a telescoping arrangement with one cylinder assembly inside the other. A cylinder inside the inner hydraulic cylinder assembly has a closed upper end secured to the upper end of the guide tube and serves as a piston rod connected to the power head. The overall stroke of the pull-down system is greater than the typical conventional length of pipe in a drill string to facilitate adding and removing lengths of pipe. The power head is floating mounted to the guide tube.

30 Claims, 7 Drawing Sheets

NO LOAD DERRICK FOR DRILLING RIG

This application is a continuation, of application Ser. No. 08/318,985filed Oct. 6, 1994, now abandoned.

BACKGROUND OF THE INVENTION

1. Field of the Invention

This invention relates generally to vehicle-mounted drilling rigs for wells and the like, and more particularly to hydraulically operated pull-down and hoisting features.

2. Description of the Prior Art

Truck-mounted drilling rigs are well known and widely used. They have ranged in size and capacity from a relatively small and light-weight, truck-mounted unit as shown in U.S. Pat. No. 2,410,959 to a relatively large and heavy unit mounted on a track-laying vehicle as shown in U.S. Pat. No. 3,867,989. The typical present day drilling rig includes winches, hydraulic cylinders, sheaves and cables or chains to raise and lower the drill pipe and the attached bit, and to force the drill bit into the ground, using the weight of the derrick and the transporting vehicle to apply the downward lead onto the drill bit. These structures are heavy, have many working components exposed to the environment, and are expensive. But even more important is the fact that it sometimes happens that, during a drilling operation, the drill bit and pipe becomes stuck in the hole. Using a machine of a current conventional design, the full force of the pull-back in efforts to get the bit out of the hole is transmitted directly to the crown sheave assembly at the top of the derrick. The load is then transmitted into the derrick structure itself. This means the available pull-back force must be limited to something less than the design capacity of the derrick to prevent derrick failure. It is therefore an object of the present invention to provide a well drilling rig overcoming some of the disadvantages of the conventional designs.

SUMMARY OF THE INVENTION

Described briefly, according to a typical embodiment of the present invention, a mobile drilling rig includes a rectangular tube used for the derrick or mast, and normally transported on the truck in a generally horizontal attitude. The mast is pivoted to a vertical position at the drilling site by a hydraulic cylinder. The drill driving power head is connected to a pull-down system located inside the mast tube. The pull-down system includes a rectangular guide tube slidably mounted inside the mast tube, and two double-acting hydraulic cylinder assemblies situated in a telescoping arrangement with one cylinder inside the other with a central feed from the bottom to the top of the inner cylinder assembly. The ram portion of the inner hydraulic cylinder assembly includes a tube with a closed upper end connected to the upper end of the guide tube and serves as a piston rod connected to the power head. The overall stroke of the pull-down system is sufficiently greater than the typical conventional length of pipe in a drill string in order to facilitate adding and removing lengths of pipe. A floating connection of the power head to the guide tube helps avoid pipe thread damage.

DESCRIPTION OF THE PREFERRED EMBODIMENT

Figure 1:
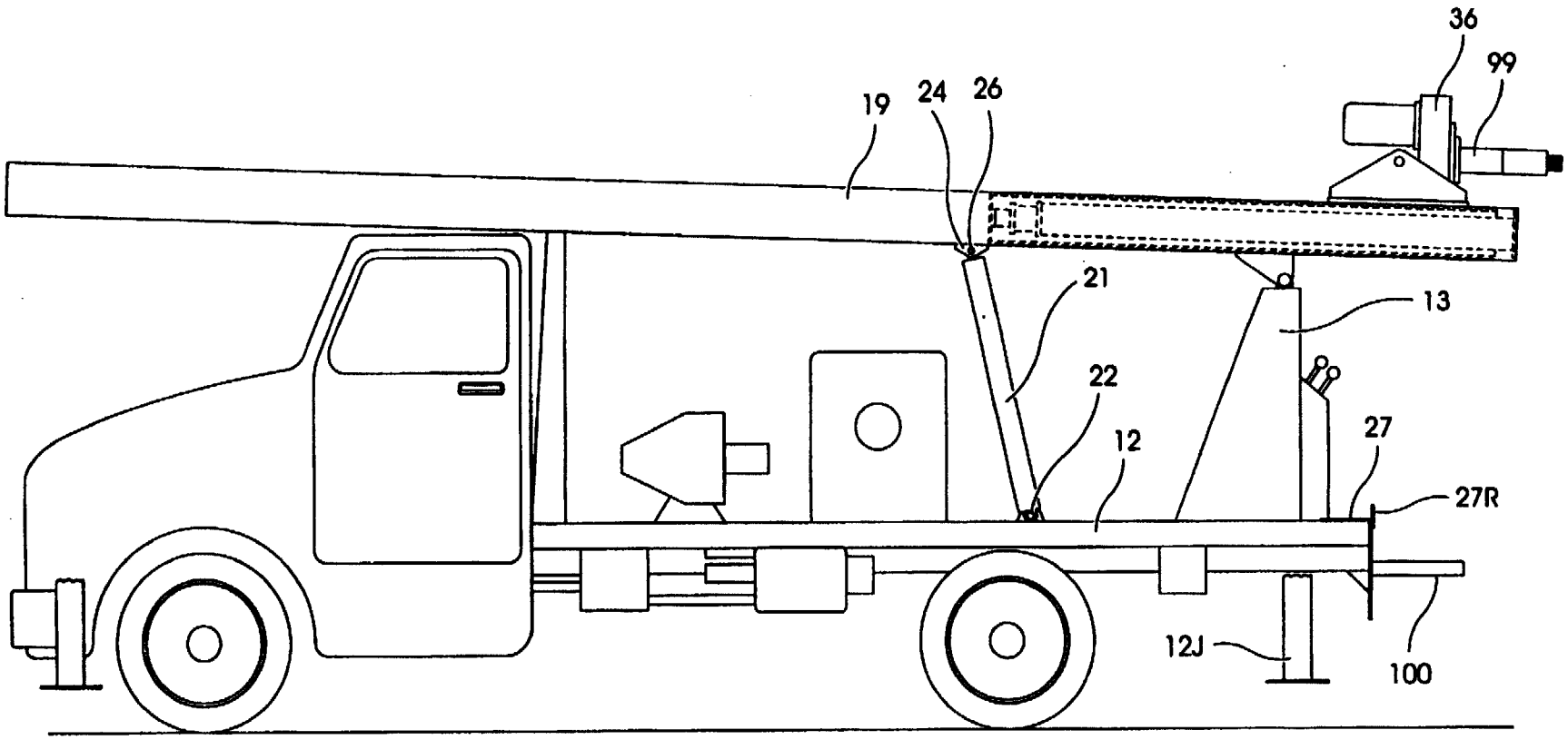
FIG. 1 is a schematic side elevational view of a truck mounted drilling rig according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, the motor truck has a bed 12 with a derrick pedestal 13 near the rear end of the bed. A hinge assembly 14 at the top of the pedestal includes the hinge journal 16 receiving a hinge pin 17 through it and to which a hinge plate 18 is pinned. A derrick tube or mast 19 is fixed to the hinge plate 18. A double-acting single rod-end hydraulic lifting cylinder 21 has its lower end pinned at 22 to the truck bed 12. The piston rod thereof 23 is pinned at bracket 24 by hinge pin 26 to the mast tube 19. This cylinder is operable to move the mast from the horizontal position in which it is stored for traveling as in FIG. 1 to the vertical position shown in FIG. 2 where the lower end of the mast assembly rests on the bearing socket plate 27 affixed to the top of the truck bed at the rear end thereof. Since the mast is a tube of square cross section twelve inches on outside dimension of each side, and one-quarter inch thick, the socket 27 is provided with upstanding walls such as 27R on all four sides so that, when the mast is erect, the lower end thereof will remain captured in the socket regardless of any transverse loads that might somehow be applied to it.

Figure 4:
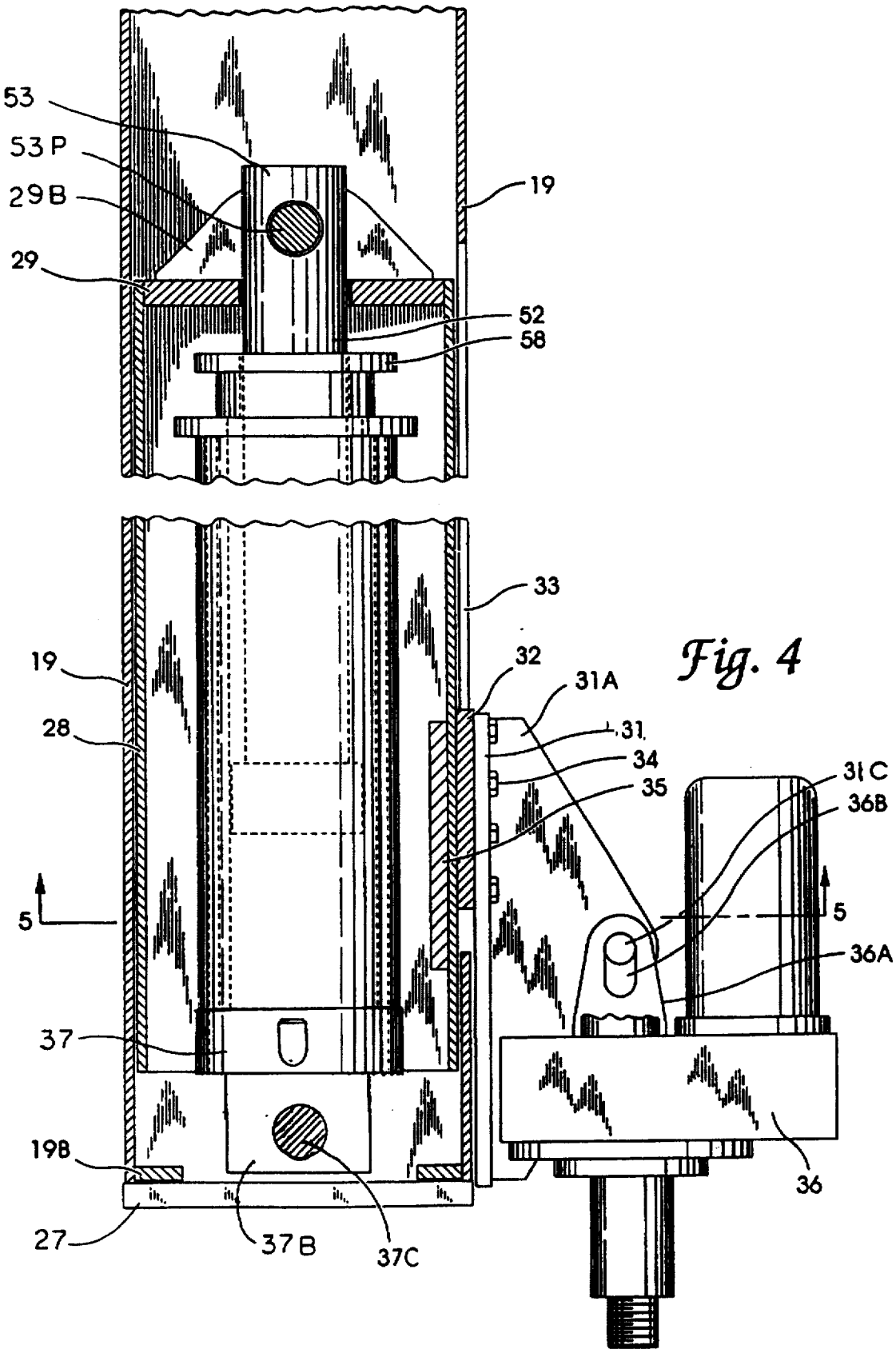
FIG. 4 is a fragmentary longitudinal sectional view of the mast showing the cylinders inside.
Figure 5:
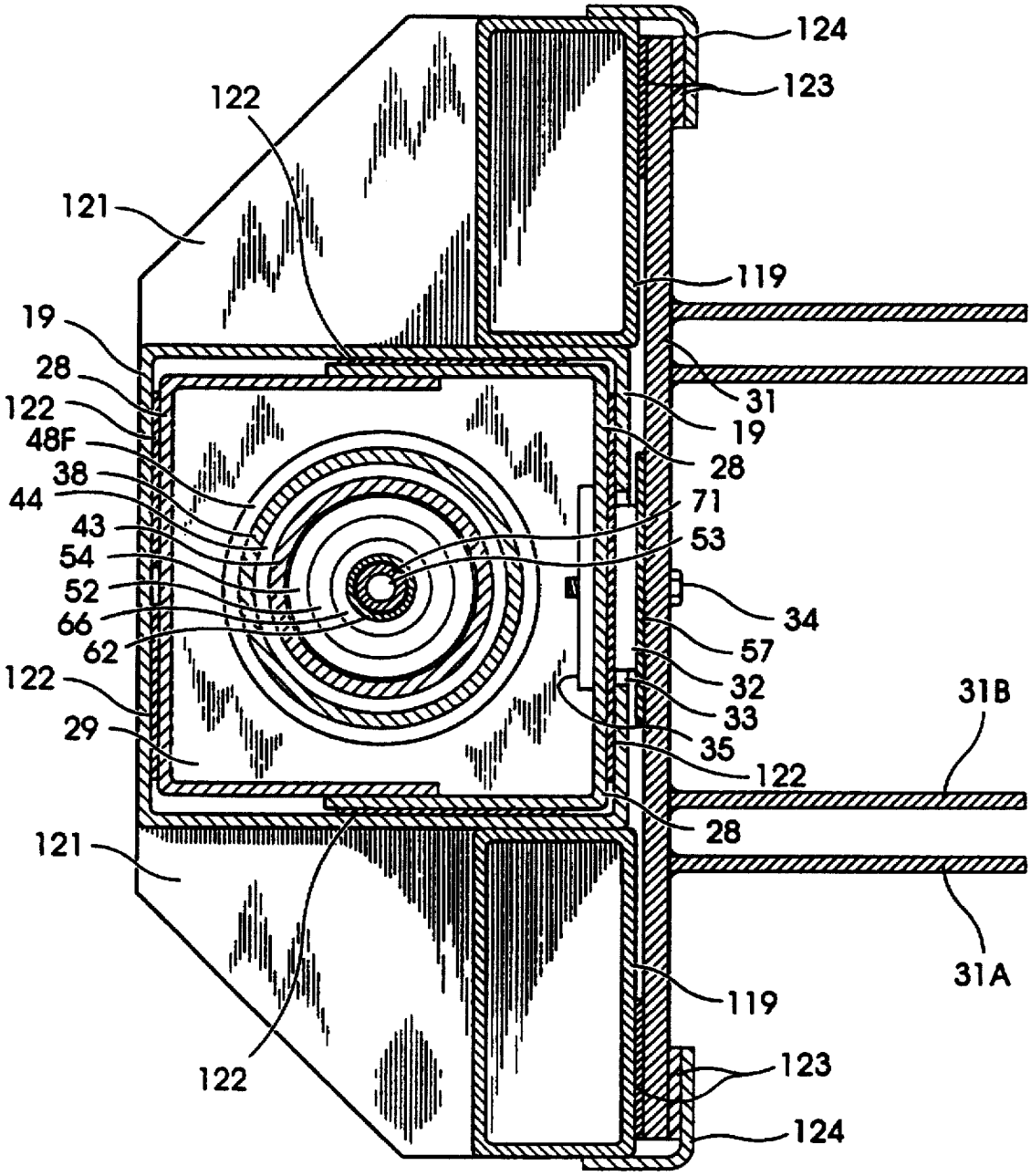
FIG. 5 is a cross sectional view through the mast assembly taken at line 5—5 in FIG. 4 and viewed in the direction of the arrows.

A second rectangular tube 28 is slidably received in the mast. It is eleven and one-quarter inch square outside dimension with a three-sixteenths inch wall thickness and has a closed upper end 29 (FIG. 4.).

A top head mounting plate 31 is provided. An elongate spacer 32 is received in an elongate slot 33 in the wall of the mast 19. The plate is fastened by bolts 34 through the spacer and guide tube 28, to a clamp plate 35 inside tube 28, fixing the bracket plate to the guide tube near the lower end of the guide tube. A drill driving top head 36 is mounted to the top head mounting plate 31. For this purpose, plate 31 serves as part of two identical clevises, one at each side, and each comprising an outer plate 31A and an inner plate 31B. The top head housing has two upstanding hanger posts 36A thereon, horizontally-spaced so that each fits inside one or the other of the two clevises. In each clevis there is a pin 31C passing through the vertically extending slot 36B of the post received in the clevis, whereby the top head is hung from the plate 31. The vertically extending slot enables some floating of the head relative to the mast and guide plate to avoid damage to threads on drill pipe and the wear sub during connection of the wear sub to, and separation of the wear sub from, lengths of drill pipe.

To provide lateral support for the mast tube 19, and to improve its rigidity, tubes 119 are provided at each side of it and welded to it and to two gussets 121 extending to the back of tube 19 and which are welded to it. To provide smooth guiding action of the tube 28 inside tube 19, wear strips 122 are provided at all four sides of the tubes. Similar strips 123 are provided between plate 31 and the tubes 119 and the vertically extending retainer flanges 124. These strips may be made of Teflon brand plastic or some other suitably low friction and long-wearing material.

To drive the top head up and down, a combination of hydraulic cylinders is provided according to this invention. This includes a first and outer hydraulic lift cylinder assembly 39 having a cylinder head base 37 (FIGS. 3 and 4) with a pair of legs 37A, 37B pivotally mounted, trunnion style, to the mast tube by a hinge pin 37C received in bearing bosses 19A and 19B welded to the lower end of the mast. When in the erect position, the lower end of the mast bears directly on the top of the socket plate 27 secured to the truck bed. The cylindrical tube 38 is welded to the base 37 and provides the cylinder wall for the outer lift cylinder assembly 39.

A second and inner hydraulic lift cylinder assembly 41 is received in and is coaxial with the outer lift cylinder 38, both being centered on the axis 42 which also is typically centered in the center of the guide tube 28. A lower seal-mounting ring 43 is affixed to the outer surface of cylindrical tube 44 of the inner cylinder 41. Circumferential grooves in ring 43 receive lower seal rings 46 and 47 which slidingly and guidingly engage the inner cylindrical surface or bore of the outer cylinder 38. An upper "rod end cylinder head" 48 for the outer cylinder 38 is affixed to the outer cylinder wall 38 with flange 48F abutting the top of tube 38. Head 48 has inwardly facing grooves therein receiving the upper guide and seal rings 49 and 51 slidably engaging the outer surface of the tube 44 of the inner cylinder assembly 41.

A combination piston and rod for the inner cylinder 44 is provided by the tube 52 closed at its upper end portion 53 and having a sleeve 54 secured and sealed around its lower end. Sleeve 54 receives two combination seal and bearing rings 56 and 57 thereon serving as piston rings slidably received on the inside face of the cylinder wall 44. In a manner similar to that for the outer cylinder, the inner cylinder 44 also has an upper ring-mounting head 58 secured to the inner surface of wall 44 of the inner cylinder. This cylinder head has piston rod seal and guide rings 59 and 61 received therein and sealingly and slidingly engaging the outer surface of the piston "rod" tube 52 which serves as the "ram" of the cylinder assembly. The upper end portion 53 of the ram extends through a hole in the top plate 29 of the guide tube and is connected by pin 53P between a pair of upstanding brackets 29B welded directly to the top plate 29 of the guide tube 28 (FIG. 4).

Figure 3:
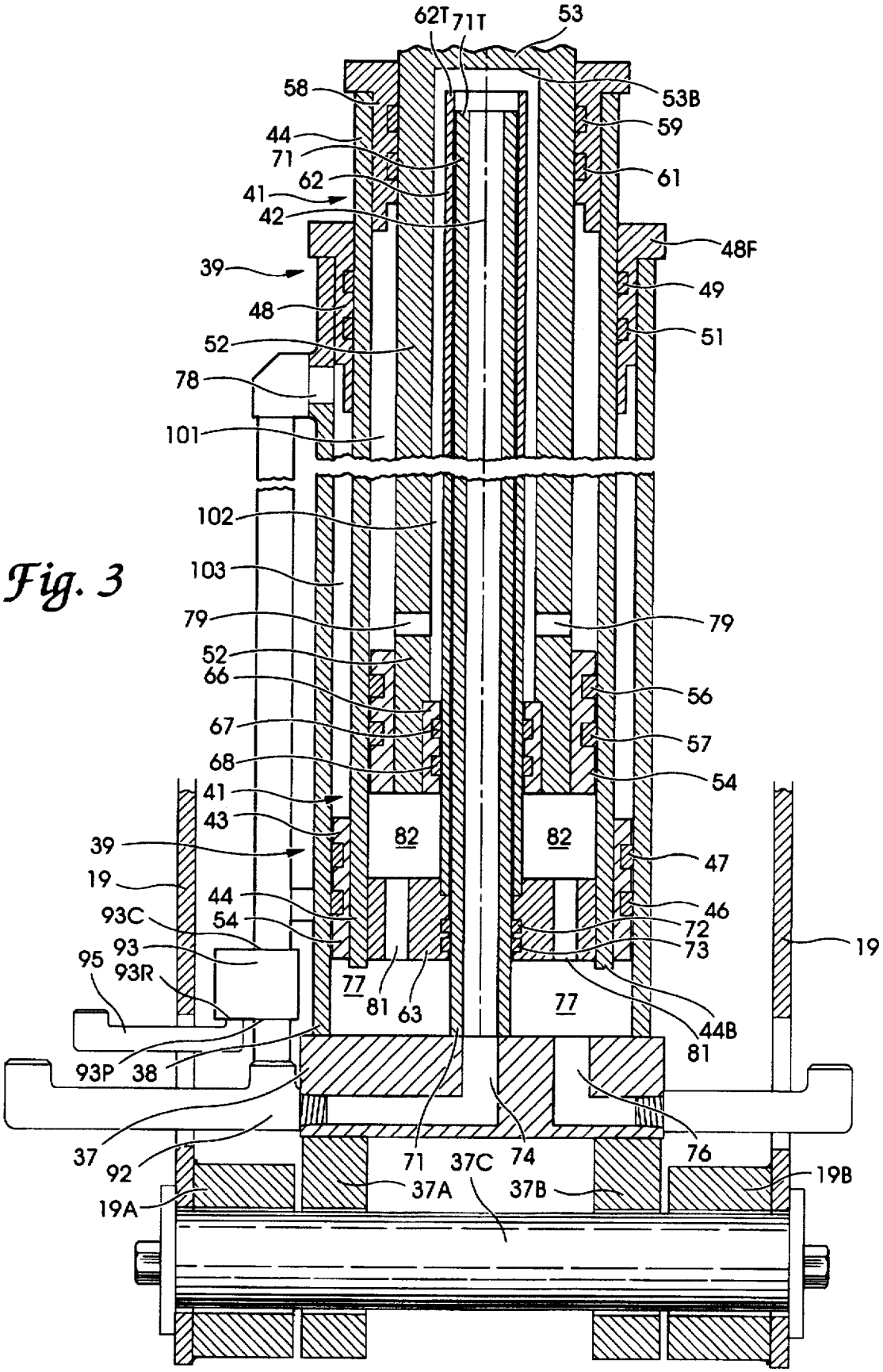
FIG. 3 is an enlarged longitudinal sectional view of the cylinder assembly itself with the cylinders retracted.

The inner cylinder assembly 41 has an inner tubular wall 62 secured to the base 63 (lower head of cylinder 44) which is secured to the outer wall 44 of the inner cylinder assembly 41. Tube 62 is coaxial with tube 44 and spaced from the inside face of ram tube 52, this spacing being maintained at the bottom of the ram tube 52 by an inner sleeve 66 secured to tube 52 and having inwardly facing circular grooves receiving combination seal and guide bushing rings 67 and 68. These seal rings 67 and 68 are slidably received on tube 62. Tube 62 is slidably received on the innermost tube 71 which is affixed at its lower end to the outer cylinder base 37 and extends up the center of the cylinder assemblies to an upper end 71T which, when the cylinder assembly is retracted as in FIG. 3, is slightly below the upper end 62T of the inner lift cylinder assembly inner wall 62. Also, during the retracted condition of the lift cylinder assembly, the upper end 62T of tube 62 is slightly spaced from the inside face 53B of the upper end portion 53 of the ram tube 52.

At the lower end of the inner cylinder assembly 41, grooves are provided in the base 63 for inner bearing guide and seal rings 72 and 73 which slidably and guidingly run on the outer surface of tube 71.

Now that the general construction of the hydraulic cylinders has been presented, provisions for communication of hydraulic fluid in the cylinders will be described. The base 37 has a first port 74 therein on the center line thereof and communicating solely through the central tube 71 of the assembly to the upper end 71T thereof. A port 76 is provided in the base and communicates with the chamber 77 below the inner cylinder assembly 41. A transverse port 78 is provided in the wall 38 of the outer cylinder near the upper seal assembly 49/51. Transverse ports 79 are provided in the wall 52 of the piston tube of the inner cylinder above the seal rings 56 and 57. Axially extending ports 81 in the base 63 of the inner cylinder assembly provide communication between the chamber 77 and chamber 82, the latter chamber being somewhat donut shaped and situated between the base 63 of the inner hydraulic cylinder and the base 52, 54 and 66 of the central piston assembly.

Figure 6:
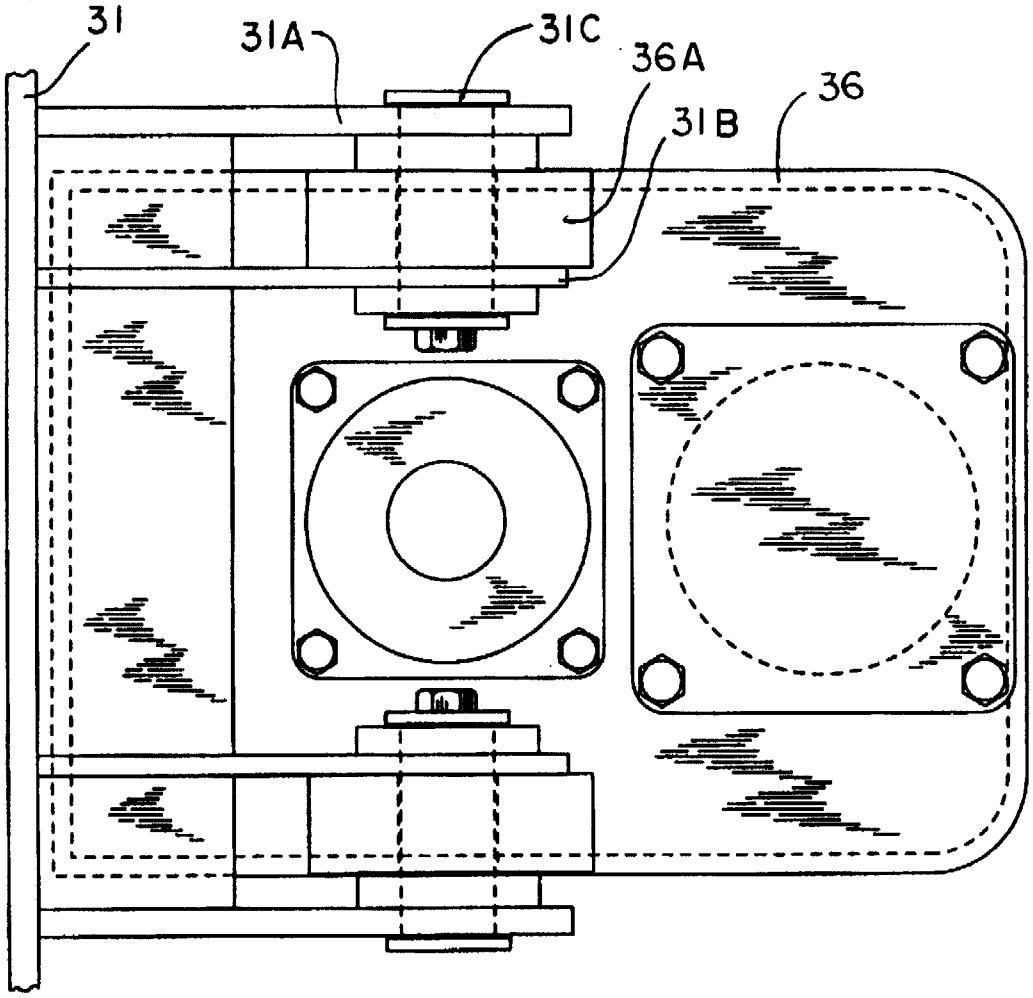
FIG. 6 is a top plan view of the top head and mounting.
Figure 7:
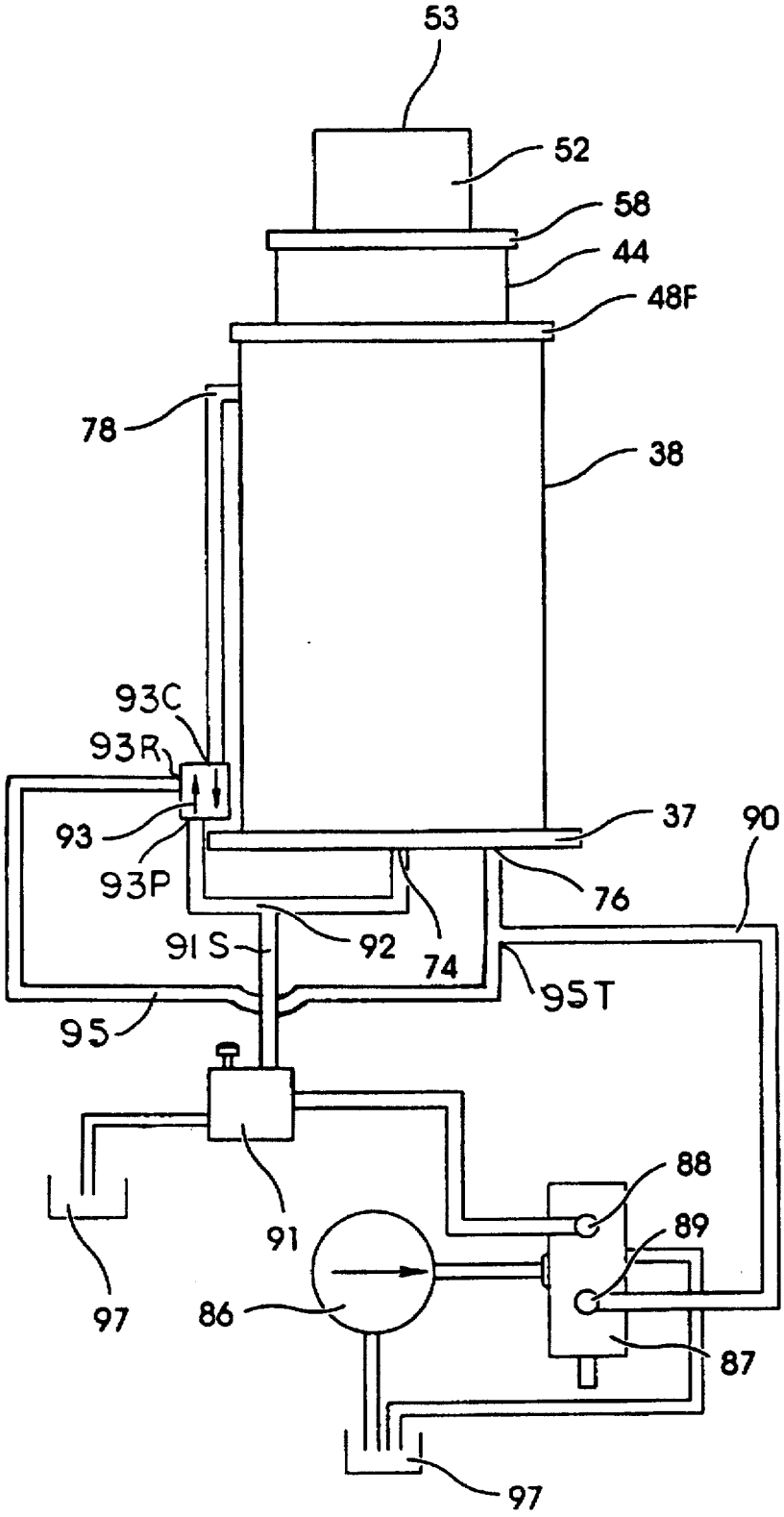
FIG. 7 is a schematic hydraulic diagram of the system for driving the cylinders inside the mast.

Having described the internal porting, and referring now to FIG. 7, the external hydraulic system will be described. It includes a pump 86 supplying the center port of a three-position control valve assembly 87 having two additional ports 88 and 89 and a return port to drain. Port 88 is coupled through and adjustable pressure regulator valve 91 to a tee 92 having one branch to the port 74 in the cylinder base 37 and the other branch to port 93P of shuttle valve 93. Port 93C of the shuttle valve communicates with port 78 in the wall of the outer cylinder. The other port of control valve 87 is coupled to port 76 in cylinder base 37. Port 93R of shuttle valve 93 is coupled through line 95 and tee 95T to port 76 for regenerative fill of chamber 77 during extension of the cylinder assembly. While this path can be outside the mast if arranged as in FIGS. 3 and 6, it could be by a passageway in base 37, if desired. The shuttle valve itself is conventional. Also, various pressure control valves typically used on current conventional machines and useful to deal with various drilling conditions are not shown as they are well known and easily incorporated with this disclosed hydraulic system.

Operation

Figure 2:
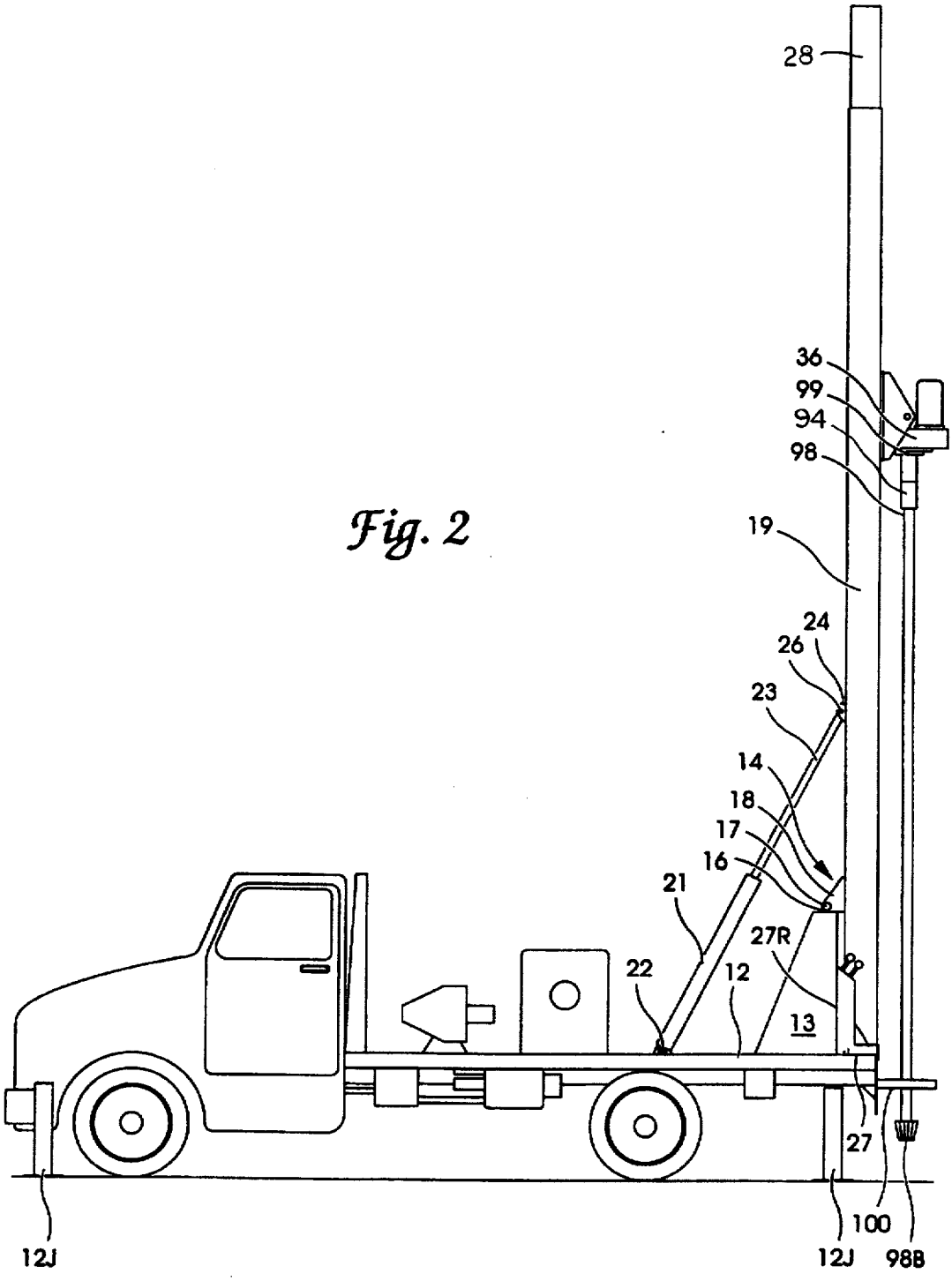
FIG. 2 is an elevational view like FIG. 1 but showing the mast erect as at a drilling site, with a first length of drill pipe in place, ready to drill.

After the truck has been located at the drilling site, the leveling jacks 12J (FIG. 2) are deployed. Then the mast is raised by actuating the cylinder 21 and then locked into the place. Then the top head 36 is to be driven upward to attach a length of pipe to the wear-sub coupling 94. For this purpose, valve 87 is shifted to apply pump pressure through valve port 89 piping 90 and main extension port 76 to the chamber 77. Pump pressure communicates through the ports 81 into the chamber 82 and there applies upward force to a ring-shaped area between the outer surface of tube 62 and the inner surface of inner cylinder wall 44. Considering that the static pressure in chambers 77 and 82 acting up and down, respectively, on base 63 are the same, with the cylinders retracted, the upward force applied to the cylinder 44 is that of the pressure in chamber 77 acting on two ring-shaped areas. One of these is the area between the inner face of outer cylinder 38 and the inner face of cylinder 44. That is 30.68 sq. in. (square inches) minus 17.72 sq. in.= 12.96 sq. in. The other area is between the outer face of tube 62 and the outer face of tube 71. That is 2.40 sq. in. minus 1.22 sq. in.=1.18 sq. in. Therefore the total upward thrust area to which pressure is applied from chamber 77 is 12.96+1.18=14.14 sq. in. The overall ring shaped area of the underside of the ram piston to which pressure in chamber 82 is applied comprises the area between tube 44 and tube 62 which is 17.72 sq. in. minus 2.40 sq. in.=15.32 sq. in. This overall upward thrust area is greater than the total upward thrust area of the above mentioned two ring shaped areas for the cylinder 44 and, since essentially the same pressure is applied to both chambers 77 and 82, the ram piston tube 52 will start upward first and drive the guide tube 28 upward. When the inner piston assembly 52, 54, 66 has fully extended (engagement of the sleeve zing 54 with head ring 58), then the cylinder/piston assembly 41 will be driven out by the pressure under it until it is stopped by engagement of the ring 43 with head ring 48 whereupon the guide tube 28 has been driven to its maximum extension (FIG. 2). As the inner piston is driven outward, any hydraulic fluid in the annular chamber 101 will pass inward through port 79 into the annular chamber 102 and up over the top 62T of tube 62 and top 71T of tube 71 and down through and out port 74 and through tee 92 and down through pressure regulator valve 91 and valve 87 to sump 97. As the cylinder 44 extends, being driven like a piston and rod out of the outer cylinder 38, hydraulic fluid in annular chamber 103 passes out through the port 78 and down through shuttle valve 93 and out port 93R thereof and through line 95 and tee fitting 95T up through port 76 into chamber 77, providing a regenerative feature to expedite fill of chamber 77 as cylinder 44 is driven upward.

Referring to FIG. 2, after a length of pipe 98 with the bit 98B at the bottom is screwed onto the wear sub 94 which has been installed on drive coupling 99 in conventional manner, and with the pipe guided in the bearing table 100, and the power head 36 rotating the drill pipe and bit, the valve 87 is shifted from neutral to open the port 88 to pump pressure. Upward flow from the tee 92 to the ports 74 and 78 begins. As pump pressure is applied from port 78 to chamber 103, and through port 74 to chamber 102, and through transfer ports 79 to chamber 101, chambers 82 and 77 are coupled through port 76, line 90 and valve 87 to drain. Consequently, the hydraulic cylinder 41 descends until it reaches the stop position where it is stopped by the bottom 44B of wall 44 abutting the top of base 37. Similarly, with pump pressure applied through port 74, pressure in chamber 102 and, through ports 79, in chamber 101 acts downward on the areas of the seal rings and their supports 54 and 66 respectively, to drive the inner piston 52, 53 downward and drive hydraulic fluid from chamber 82 through ports 81 and chamber 77 and valve 87 to sump. The thrust area for retraction (pull-down) of the cylinder 44 is the 6.93 sq. in. in chamber 103. The thrust area for pull-down of ram 52 is the 7.40 sq. in. area in chamber 101 minus the 2.40 sq. in. area of center tubes 71 and 62 which equals 5.0 sq. in. Therefore, cylinder 44 will retract first and then the ram 52 will retract in the cylinder 44. Rate of travel of the cylinder and piston assemblies in both directions, can be controlled by selection and adjustment of pressure regulator and relief valves.

It is preferable that the outer cylinder 38 have a 6 ¼ inch bore and 11 foot 6 inch stroke. It is preferable that the stroke of the inner cylinder piston also be 11 feet 6 inches, thus, providing a total 23 foot travel up for the guide tube. This is ample to provide for installing and removing standard 20 foot lengths of drill pipe. For good guidance, it is preferable that the outer tube or mast be 32 feet long and that the guide tube be 11 feet 6 inches long. Comparison of the thrust areas for retraction (pull-down) and extension (pull-back) indicates much greater area for pull-back. As indicated above, the area for pull-down is 5.0 sq. in. The total thrust area of the two piston assemblies and which is available for pull-back of a stuck bit is 15.32 sq. in. plus 14.14 sq. in.=29.46 sq. in.

After a full downward stroke of the cylinder assemblies, the ram may be jogged upward slightly to move the head mounting pins 31C to the upper ends of their slots. Then rotation of the head can be reversed, unscrewing the wear sub from the pipe in the well, during which the pins 31C can rise in the slots and allow the head to rise as the wear sub threads easily unscrew from the pipe. This floating feature is also advantageous in connecting the next length of pipe to the pipe string in the well.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. In a drilling rig, the combination comprising:

a mast disposed in a vertical attitude for supporting a well drilling head;

a drilling head mounting carriage movable up and down along the mast;

a first hydraulic cylinder assembly having a cylinder connected to the mast and held in a first position inside the mast, the first cylinder assembly having a first piston vertically movable in the cylinder;

a second hydraulic cylinder assembly and including the first piston of the first cylinder assembly, and the second hydraulic cylinder assembly having a second piston vertically movable in relative to the first piston of the first cylinder assembly, the carriage being coupled to the second piston; and a drill driving head coupled to the carriage.

2. The combination of claim 1 and further comprising a first carriage; and wherein:

the mast comprises a first tube mounted on the first carriage for transportation of the tube from site-to-site, said tube being movable relative to the carriage from a generally horizontal attitude for transportation, to a vertical attitude for well drilling; and a second tube slidably received in the first tube and movable from a stored position to an extended position; and the drilling head carriage is a second carriage;

the second carriage being connected to the second tube and linearly drivable by the second tube along the first tube; and the first cylinder of the first hydraulic cylinder assembly includes a third tube fixed relative to the first tube and inside the second tube; and the first piston of the first hydraulic cylinder assembly includes a fourth tube inside the third tube and slidably received in the third tube and movable from a stored position in the third tube to an extended position thereon; and the second piston of the second hydraulic cylinder assembly includes a fifth tube inside the fourth tube and slidable therein from a stored position therein to an extended position therein; and a sixth tube is inside the fifth tube and secured to the fourth tube coaxial therewith; and a seventh tube is inside the sixth tube and secured to the third tube and coaxial therewith; and the drill driving head fastened to the second carriage.

3. The combination of claim 2 and wherein:

the third tube and the seventh tube are cylindrical and have a common base cooperating therewith to form a first, upwardly-opening hollow cylindrical chamber;

a first set of hydraulic fluid openings communicating with the third tube;

the fourth and sixth tubes are cylindrical and have a second common base cooperating therewith to form a second, upwardly-opening hollow cylindrical chamber;

a second set of hydraulic fluid openings communicating with the fifth tube;

a first set of sliding seals sealing the third tube to the fourth tube and forming an annular chamber between the third and fourth tubes and cooperating with the third and fourth tubes and the first set of hydraulic fluid openings for forming a double-acting assembly of said first hydraulic cylinder assembly; and a second set of sliding seals sealing the fourth tube to the fifth tube and cooperating with the fourth and fifth tubes and the second set of hydraulic fluid openings for forming a double-acting assembly of said second hydraulic cylinder assembly.

4. The combination of claim 3 and wherein:

the third and fourth tubes have the first set of seals so situated, and the second cylinder assembly is so oriented in the third tube as to function in combination with the third tube as a first piston-rod assembly.

5. The combination of claim 4 and wherein:

the fourth and fifth tubes have the second set of seals so situated, and the fifth tube is so-oriented in the fourth tube as to function in combination with the fourth tube as a second piston-rod assembly.

6. The combination of claim 5 and wherein:

the second tube is connected to the fifth tube and drivable upward by the fifth tube.

7. The combination of claim 6 and further comprising:

a source of hydraulic fluid pressure:

a first, three-position valve coupled to the source and operable in one position thereof to supply hydraulic fluid driving pressure through selected ones of said first and second sets of hydraulic fluid openings to drive the first and second piston-rod assemblies outward to drive the second tube to the extended position and, operable in a second position thereof to drive the first and second piston-rod assemblies inward to return the second tube to the stored position.

8. The combination of claim 7 and further comprising:

a second valve coupled to certain ones of said first and second sets of hydraulic fluid openings to selectively control flow direction between one of the openings and the other of the openings.

9. The combination of claim 8 and wherein:

the second valve is a shuttle valve.

10. The combination of claim 2 and wherein:

the first carriage is a truck.

11. The combination of claim 1 and further comprising:

a floating coupling of the drill driving head to the second piston.

12. The combination of claim 1 and wherein:

the hydraulic cylinder assemblies are double acting; and the second hydraulic cylinder assembly has a ram and an axially extending supply tube;

the second cylinder assembly being supplied at one end with hydraulic fluid from inside the first cylinder assembly to drive the ram outward, and supplied with hydraulic fluid through a central tube to drive the ram inward.

13. The combination of claim 1 and further comprising:

a hydraulic power system coupled to said cylinder assemblies and including valve means switchable to one condition applying hydraulic fluid pressure to the pistons in amounts and direction to extend the pistons to drive the drill driving head upward.

14. The combination of claim 13 and wherein:

the first and second cylinder assemblies are so configured, that the difference in areas between the first piston and the second piston cause the second piston to extend preferentially to the first piston.

15. The combination of claim 13 and wherein:

the valve means are switchable from the one condition to another condition applying hydraulic fluid pressure to the pistons in amounts and direction to retract the pistons to drive the drill driving head downward.

16. The combination of claim 15 and wherein:

the first and second cylinder assemblies are so configured that the difference in areas between the first piston and the second piston cause the first piston to retract preferentially to the second piston.

17. The combination of claim 13 and wherein:

the valve means are switchable to another condition applying hydraulic fluid pressure to the pistons in amount and direction to retract the pistons and drive the drill driving head downward.

18. The combination of claim 17 and wherein:

there are hydraulic fluid passageways in said first and second hydraulic cylinder assemblies, and said first piston has a first area operable upon by fluid pressure when the valve means are in a first condition, and said second piston has a second area operable upon by fluid pressure when the valve means are in a second condition to provide, for a given pressure differential, a greater force for extending the pistons in the first valve condition than for retracting the pistons in the second valve condition.

19. The combination of claim 1 and further comprising a first carriage and wherein the mast comprises:

a first tube mounted on the first carriage for transportation of the tube from site-to-site, said tube being movable relative to the carriage from a generally horizontal attitude for transportation, to a vertical attitude for well drilling; and a second tube received in the first tube and slidably movable in the first tube from a stored position to an extended position.

20. The combination of claim 19 and wherein:

the first and second tubes are polygonal in cross-section.

21. The combination of claim 19 and wherein:

the first and second tubes are square in cross section;

the first tube has parallel sides;

lateral support tubes are affixed to the sides of the first tube.

22. The combination of claim 21 and wherein:

the first tube has a front and a back;

gussets are welded to the support tubes and extend toward the back of the first tube and are welded to the first tube.

23. The combination of claim 19 and further comprising:

a base plate fixed to the first carriage; and a lower end of the first tube bears on the base plate when the first tube is in the vertical attitude.

24. The combination of claim 23 wherein the cylinder has a lower end, the combination further comprising:

a trunnion pivotally connecting a lower end of the cylinder to the lower end of the first tube.

25. The combination of claim 19 and wherein:

the drilling head mounting carriage is fixed to the second tube.

26. The combination of claim 25 and wherein:

the second tube is connected to the second piston.

27. The combination of claim 26 and wherein:

the second tube is pinned to the second piston.

28. The combination of claim 26 and wherein:

the first tube has a vertically-extending slot therein;

a clamping plate is located inside the second tube;

the drilling head mounting carriage includes a mounting plate; and a fastener extends through the slot and is attached to the clamping plate.

29. The combination of claim 28 and wherein:

the first and second tubes are polygonal in cross-section;

the first tube has parallel sides;

lateral support tubes are affixed to the sides of the first tube and have front faces; and the mounting plate is slidably supported by the lateral support tubes as the second tube slides longitudinally inside the first tube.

30. The combination of claim 28 and further comprising:

a pair of clevises projecting horizontally from the mounting plate, each clevis having a vertically extending slot therein;

a pair of hanger posts on the driving head;

a pair of clevis pins extending through the posts and the clevis slots and connecting the head to the clevises and accommodating limited vertical floating of the head relative to the mounting plate.

* * * * *